US011465272B1

(12) United States Patent
Date

(10) Patent No.: US 11,465,272 B1
(45) Date of Patent: Oct. 11, 2022

(54) CORDLESS TOOL HOLDING APPARATUS

(71) Applicant: David Paul Alan Date, La Selva Beach, CA (US)

(72) Inventor: David Paul Alan Date, La Selva Beach, CA (US)

( * ) Notice: Subject to any disclaimer, the term of this patent is extended or adjusted under 35 U.S.C. 154(b) by 0 days.

(21) Appl. No.: 17/443,980

(22) Filed: Jul. 29, 2021

Related U.S. Application Data

(60) Provisional application No. 63/183,336, filed on May 3, 2021.

(51) Int. Cl.
*B25H 3/04* (2006.01)
*B25H 3/00* (2006.01)

(52) U.S. Cl.
CPC ..... *B25H 3/04* (2013.01); *B25H 3/006* (2013.01)

(58) Field of Classification Search
CPC ..... B25H 3/04; B25H 3/006; B25H 3/003; B25H 3/06
See application file for complete search history.

(56) References Cited

U.S. PATENT DOCUMENTS 6,279,741 B1 8/2001 Arvin
6,305,557 B1 * 10/2001 Brooks ..... B25H 3/04 211/94.01
6,321,622 B1 11/2001 Tsuge
6,484,892 B1 * 11/2002 Gooner ..... B25H 3/04 248/176.2
7,290,655 B1 11/2007 Wood
7,591,385 B2 * 9/2009 Brooks ..... B25H 3/04 211/94.01
8,136,775 B2 * 3/2012 Chiang ..... F16M 11/2085 248/225.11
9,937,615 B1 4/2018 Winnard
10,065,303 B1 9/2018 Engebretson
10,500,713 B2 * 12/2019 Velderman ..... B25H 3/00
10,702,984 B2 * 7/2020 Greta ..... B25H 3/023
10,966,891 B2 * 4/2021 Kitt ..... A61G 12/008
2005/0247653 A1 * 11/2005 Brooks ..... A47F 5/0846 211/94.01
2005/0247841 A1 * 11/2005 Brooks ..... B25H 3/04 248/316.8

(Continued)

FOREIGN PATENT DOCUMENTS

GB 2347884 B 4/2001
JP 2011235372 A 2/2014

*Primary Examiner* — Kimberley S Wright
(74) *Attorney, Agent, or Firm* — Emanus, LLC; Willie Jacques

(57) ABSTRACT

A cordless tool holding apparatus is disclosed. The cordless tool holding apparatus comprises a rack having a first shelf and a second shelf configured to couple with each other via side walls. The second shelf comprises a plurality of extended portions. The cordless tool holding apparatus further comprises at least one snap-fit assembly coupled to at least one surface of each extended portion of the plurality of extended portions. The at least one snap-fit assembly comprises a body, at least one ramp coupled to the body and integrated on at least one side wall of the at least one snap-fit assembly, and at least one rib coupled to the body and integrated on the at least one side wall of the at least one snap-fit assembly. Further, the at least one snap-fit assembly is configured to detachably couple at least one cordless tool.

19 Claims, 11 Drawing Sheets

(56) References Cited

U.S. PATENT DOCUMENTS

| | | | | |
|---|---|---|---|---|
| 2006/0088377 | A1 | 4/2006 | Rejman | |
| 2006/0260964 | A1* | 11/2006 | Feldmann | B25H 3/006 206/373 |
| 2007/0012636 | A1* | 1/2007 | Wisnoski | A47F 5/0846 211/94.01 |
| 2008/0006592 | A1* | 1/2008 | Brooks | A47F 5/0846 211/89.01 |
| 2009/0145866 | A1* | 6/2009 | Panosian | A47F 5/0838 211/85.15 |
| 2014/0366390 | A1* | 12/2014 | Lampley | B65H 75/34 30/537 |
| 2017/0259422 | A1 | 9/2017 | Takeyama | |
| 2018/0279752 | A1 | 10/2018 | Woodhams | |
| 2018/0345478 | A1* | 12/2018 | Grela | B25H 3/006 |
| 2019/0077006 | A1* | 3/2019 | Velderman | B23B 45/001 |
| 2019/0255697 | A1* | 8/2019 | Manalang | B25H 3/003 |
| 2020/0070334 | A1* | 3/2020 | Velderman | B23B 45/001 |
| 2020/0189090 | A1* | 6/2020 | Grela | B25H 3/006 |
| 2021/0078158 | A1 | 3/2021 | Wages | |

* cited by examiner

CORDLESS TOOL HOLDING APPARATUS

FIELD OF THE DISCLOSURE

The invention relates to assemblies for holding cordless tools. More particularly, the invention relates to a cordless tool holding assembly for securely griping cordless tools to store and transport the cordless tools in a hassle-free manner without the risk of damage to the cordless tools.

BACKGROUND OF THE DISCLOSURE

The subject matter discussed in this background section should not be assumed to be prior art merely as a result of its mention herein. Similarly, any problems mentioned in this background section or associated with the subject matter of this background section should not be assumed to have been previously recognized in the prior art. The subject matter as disclosed in this background section merely represents different approaches related to assemblies for holding wireless tools, wherein such assemblies themselves may also correspond to implementations of the claimed technology and invention.

In today's era, the advancement of technology is happening at a fast pace. Earlier, most labor was performed manually, and the tasks were considerably time consuming, such as nailing a picture frame on a wall, drying wet hair, picking and stacking product and the like. Further, the tasks could be very difficult and tedious. To overcome these problems, various tools were introduced like drilling guns, hair dryers, conveyors and ladders, and other similar tools. These tools made the tasks easier and effortless; however, these tools required the provision of power supplied via wire. Such tools limited the user to perform the needed task near a power supply.

To free the tools from the entanglement of wires and make them work easily away from a source of power supply, wireless tools were introduced. Wireless tools are operated using batteries so there is no need to connect a power cable to the tool for performing the tasks. An important consideration, however, is that wireless tools have delicate parts that may become damaged due to handling, even from a light jerk. Such characteristics of wireless tools makes it important to store and/or transport the wireless tools with care. Therefore, to overcome the problem of proper storage and transportation of wireless tools, various wireless tool holders were introduced. These wireless tool holders grip the tool in an effort to keep them safe and secure.

Prior art, for various aspects contained there within, relevant to this disclosure includes U.S. Pat. No. 10,065,303 to Engebretson, U.S. Pat. Publication No 2016/0215561 to Austin, U.S. Pat. Publication No. 2010/044405 to John, and U.S. Pat. Publication No. 2003/0085243 to Peter. In each of these prior art references, an assembly is provided for holding wireless tools. The art still begs for an ideal solution to the problem of storing and transporting wireless tools securely.

In particular, the Engebretson reference '303 discloses a retention device that keeps hand held power tools in a stable and upright position. The retention device may minimize the risk of the tool being dropped and damaged. The prior art further discloses multiple plates connected to each other through notches and the first plate adhesively attachable to a hand-held power tool. However, unlike the subject matter of the disclosed invention, Engebretson does not discuss or suggest locking of the tool with a retention device. Further, Engebretson does not suggest or disclose a hassle-free way of transporting the wireless/hand held tool.

Reference '561 to Austin discloses a power tool storage apparatus, including a base member shaped to be secured to a storage surface; and a tool engaging portion extending from the base member. The tool engaging portion is shaped to physically engage a battery pack slot of a power tool, such that attaching the power tool to the tool engaging portion secures the power tool to the storage surface. However, unlike the subject matter of the disclosed invention, Austin does not discuss or suggest the aspect of storing any size of wireless tool or using a snap-fit assembly for attaching the power tool.

Reference '405 to John discloses a holster for holding a power tool is disclosed, the holster comprises a mount securable to a support surface, such as a belt, and a tool clip shaped to securely engage the tool. The tool clip is securely connectable to the mount. However, unlike the subject matter of the disclosed invention, John does not discuss or suggest the aspect of holding any other wireless tool apart from the drill gun or using a snap-fit assembly for holding the drill gun.

Reference '243 to Peter discloses a tool accessory that is capable of securing a cordless tool, particularly a cordless power tool having a handle member with a lower flanged end in order to provide the tool with means to enable it to be suspended from a holding device. The prior art further discloses a tool holder adaptor that is secured to the handle of a cordless tool, such as a cordless power drill in a way that the cordless tool may be suspended from a belt clip hook member. However, unlike the subject matter of the disclosed invention, Peter does not disclose supporting the whole body of the wireless tool that may cause difficulty in transporting the wireless tool. Further, Peter does not discuss or suggest the aspect of a snap-fit assembly for securing the handle of the cordless tool.

The current market solutions for securing wireless tools, all involve storing a similar type or size of wireless tools. Therefore, in light of the above discussion and given the deficiencies of the prior art, there is a need for an effective assembly to secure wireless tools of any size and for storing, transporting, and locking wireless tools with proper support further protecting them from any kind of damage.

SUMMARY OF THE DISCLOSURE

According to embodiments illustrated herein, a novel, simple, and easy-to-use cordless tool holding apparatus is disclosed. The cordless tool holding apparatus comprises a rack having a first shelf and a second shelf. The first shelf and the second shelf are configured to couple with each other via side walls, and the second shelf having a plurality of extended portions. The side walls of the rack include at least one handle, for lifting the rack from a base. The first shelf is parallel to the second shelf, in a transverse direction. The cordless tool holding apparatus further comprises at least one snap-fit assembly coupled to at least one surface of each extended portion of the plurality extended portions. Further, each extended portion of the plurality of extended portions comprises a first plurality of holes to couple to a second plurality of holes of the at least one snap-fit assembly, using a plurality of screws. It should be noted that the second plurality of holes is integrated within the body of the at least one snap-fit assembly.

Further, the at least one snap-fit assembly comprises a body which is a central part of the snap-fit assembly. Further, the at least one snap-fit assembly comprises at least one ramp coupled to the body and integrated on at least one side wall of the at least one snap-fit assembly. Further, the at least one ramp is configured to receive a base section of at least one cordless tool. The at least one ramp comprises a protruded portion extending outwards from a side of the at least one snap-fit assembly and is configured to receive side walls of the base section of the at least one cordless tool. Further, the protruded portion pushes the side walls of the base section of the at least one cordless tool and retains the at least one cordless tool in place. The at least one snap-fit assembly further comprises at least one rib coupled to the body and integrated on the at least one side wall of the at least one snap-fit assembly. Further, the at least one rib is configured to securely lock the base section after being received by the at least one ramp. The at least one snap-fit assembly is configured to detachably couple the at least one cordless tool, with the at least one ramp and the at least one rib. Such use of the snap-fit assembly facilitates locking the at least one cordless tool on the cordless tool holding apparatus.

Further, the at least one snap-fit assembly further comprises at least one ramp-break integrated at one end of the at least one ramp and is configured to allow the base section of the at least one cordless tool to be pushed over the at least one rib. The at least one rib couples with a battery clip of the at least one cordless tool for a secure lock. Such cordless tool apparatus facilitates in easy storage and transportation of the at least one cordless tool.

Yet further, the rack includes a back wall, for coupling the first shelf, the second shelf, and the side walls of the rack. The back wall includes a plurality of key holes, for mounting the rack on the base. The plurality of key holes facilitates mounting the cordless tool holding apparatus using a mounting screw assembly. The mounting screw assembly comprises a mounting clip configured to receive a mounting screw, via at least one key hole of the plurality of key holes.

In one embodiment, two snap-fit assemblies are configured to be coupled to the extended portion of the rack in a double stack configuration. The double stack configuration facilitates coupling a first snap-fit assembly to a first surface of each extended portion and a second snap-fit assembly to a second surface of each extended portion, using a plurality of screws. Further, such usage of the double stack configuration assists in storing more number of cordless tools in a predefined space.

In one embodiment, the first shelf comprises a third plurality of holes to couple at least one snap-fit assembly for mounting the at least one cordless tool. In one alternate embodiment, the snap-fit assembly further comprises an end groove integrated at an end of the at least one ramp. Further, the end groove is a curved cavity configured to receive the side walls of the base section of the at least one cordless tool.

Other features and aspects of this disclosure will be apparent from the following description and the accompanying drawings.

BRIEF DESCRIPTION OF THE DRAWINGS

The accompanying drawings illustrate various embodiments of systems, methods, and embodiments of various aspects of the disclosure. Any person of ordinary skill in the art will appreciate that the illustrated element boundaries (e.g., boxes, groups of boxes, or other shapes) in the figures represent one example of the various boundaries representative of the disclosed invention. It may be that in some examples one element may be designed as multiple elements or that multiple elements may be designed as one element. In other examples, an element shown as an internal component of one element may be implemented as an external component in another and vice versa. Furthermore, elements may not be drawn to scale. Non-limiting and non-exhaustive descriptions of the present disclosure are described with reference to the following drawings. The components in the figures are not necessarily to scale, emphasis instead being placed upon the illustrated principles.

Various embodiments will hereinafter be described in accordance with the appended drawings, which are provided to illustrate and not to limit the scope of the disclosure in any manner, wherein similar designations denote similar elements, and in which.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Some embodiments of this disclosure, illustrating all its features, will now be discussed in detail. The words "comprising," "having," "containing," and "including," and other forms thereof, are intended to be equivalent in meaning and be open-ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context dictates otherwise. Although any systems and methods similar or equivalent to those described herein can be used in the practice or testing of embodiments of the present disclosure, the preferred systems, and methods are now described.

Embodiments of the present disclosure will be described more fully hereinafter with reference to the accompanying drawings in which like numerals represent like elements throughout the several figures, and in which example embodiments are shown. Embodiments of the present disclosure may, however, be embodied in alternative forms and should not be construed as being limited to the embodiments set forth herein. The examples set forth herein are non-limiting examples and are merely examples among other possible examples.

Figure 1A:
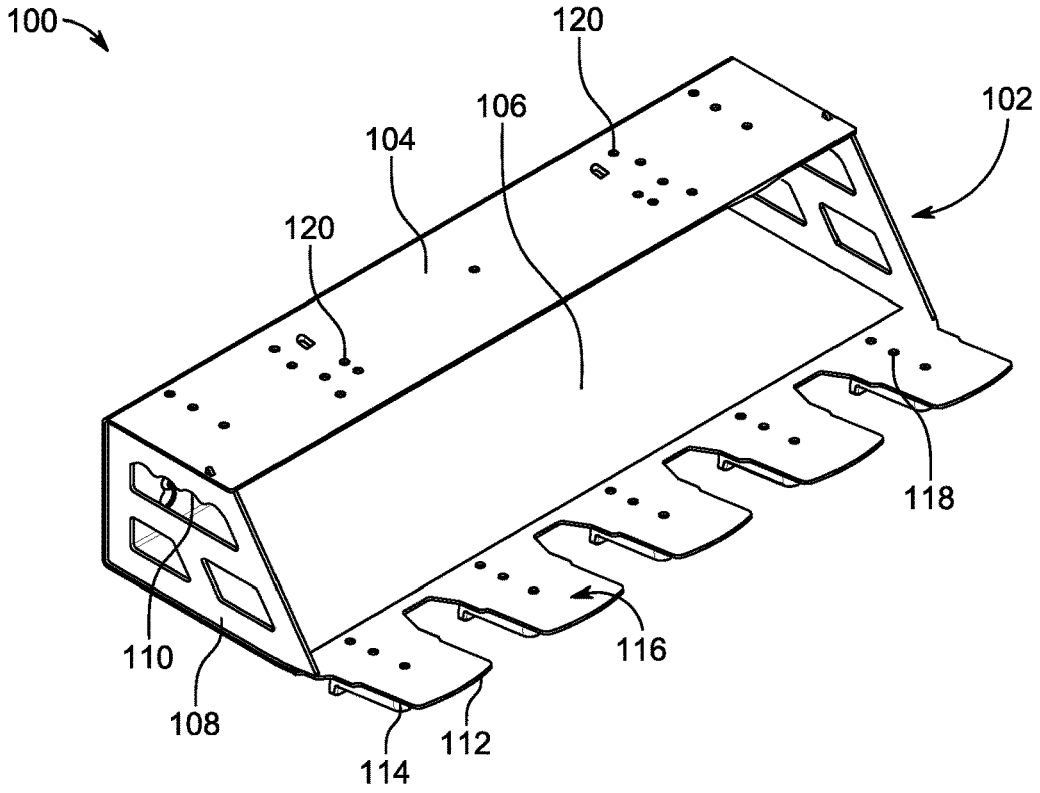
FIG. 1A illustrates a perspective view of a cordless tool holding apparatus, according to an embodiment of the present disclosure.
Figure 1B:
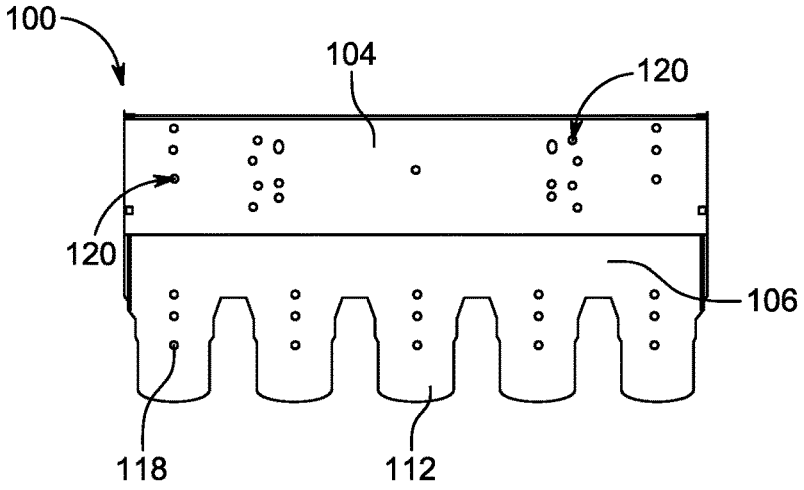
FIG. 1B illustrates a top view of the cordless tool holding apparatus, according to an embodiment of the present disclosure.

FIG. 1A illustrates a perspective view of a cordless tool holding apparatus 100, according to an embodiment of the present disclosure. FIG. 1A is described in conjunction with FIGS. 1B-1E.

In one exemplary embodiment, the cordless tool holding apparatus 100 may be employed for holding or storing or stacking a plurality of cordless tools (not shown) which is used in applications on a commercial or residential scale. The cordless tool holding apparatus 100 may be referred to as a tool holder or a portable tool holding apparatus. The cordless tool holding apparatus 100 may comprise a rack 102 having a first shelf 104 and a second shelf 106. Further, the first shelf 104 and the second shelf 106 may be coupled to each other via side walls 108. Further, the side walls 108 may be provided with at least one handle 110. Further, the second shelf 106 may comprise a plurality of extended portions 112. The cordless tool holding apparatus 100 may further comprise at least one snap-fit assembly 114 coupled with at least one surface of each extended portion 112 of the plurality of extended portions 112.

Figure 2:
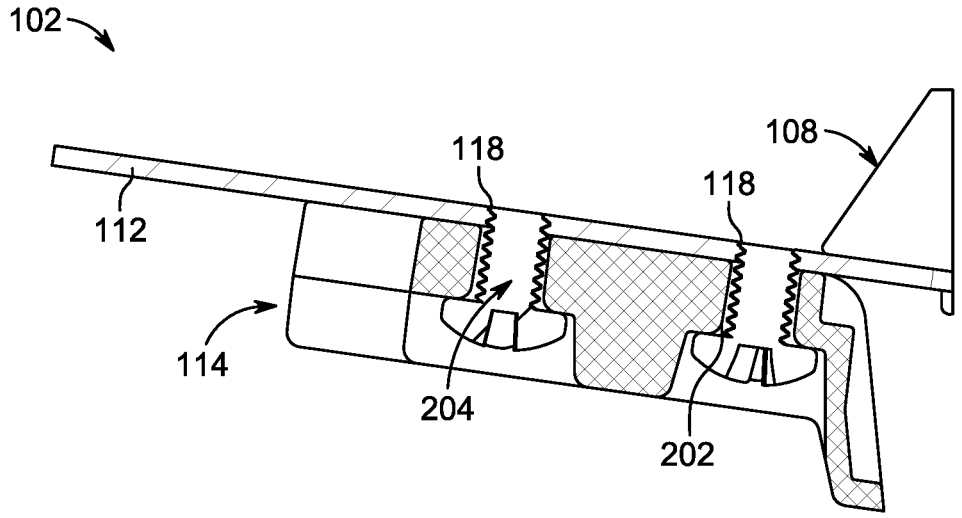
FIG. 2 illustrates a sectional side view of a snap-fit assembly coupled with the extended surface of the cordless tool holding apparatus, according to an embodiment of the present disclosure.

Further, each extended portion 112 of the plurality of extended portions 112 may correspond to a tapered section 116. In one embodiment, the tapered section 116 of each extended portion may facilitate reliability and durability of each extended portion 112. In one embodiment, the tapered section 116 may be a section with a reduced thickness at one end of each extended portion 112. In one exemplary embodiment, each extended portion 112 may include a cover wrapped around the tapered section 116. It can be noted that the cover may be referred as an additional piece, which may be made of a material selected from a group of materials of, plastic, glass fiber, or metal. It can be noted that the tapered section 116 may be provided to achieve a uniform load distribution of at least one cordless tool over the at least one surface of each extended portion 112. Further, the tapered section 116 may be provided to reduce vibrations of the cordless tool holding apparatus 100 when the at least one cordless tool is mounted over each extended portion of the plurality of extended portions 112. Each extended portion 112 may comprise a first plurality of holes 118 for coupling with a second plurality of holes (as shown in FIG. 2) of the at least one snap-fit assembly 114. The first plurality of holes 118 may be coupled with the second plurality of holes, using a plurality of fasteners. In one embodiment, the plurality of fasteners is a screw of a pre-defined dimensions. Further, the first shelf 104 may comprise another set of holes 120. Further, the first shelf 104 may facilitate holding at least one snap-fit assembly 114, using the another set of holes 120. In one embodiment, the another set of holes 120 may be spaced apart from each other at a predefined distance. In one exemplary embodiment, the another set of holes 120 may be spaced at least 1.75 inches apart from each other. In one exemplary embodiment, the cordless tool holding apparatus 100 may comprise a plurality of racks. In one embodiment, the first shelf 104 may be referred to as an upper shelf and the second shelf 106 may be referred as a lower shelf. In an embodiment, the first shelf 104 and the second shelf 106 may be attached to the side walls 108 of the rack 102 using fusion welding. In one embodiment, the rack 102, the first shelf 104, and the second shelf 106 may be made from a material selected from a group of materials including an alloy steel, iron, aluminum, plastic, fiberglass, any possible material capable of coupling via a fusion weld bond, or any possible material capable of coupling via a non-fusion weld bond. It can be noted that the use of plastic and fiberglass may facilitate affordability to manufacture the rack 102, the first shelf 104, and the second shelf 106 as a single unit. In one embodiment, the rack 102, the first shelf 104, and the second shelf 106 may be coupled together using riveting joints or by folding corners of the rack 102, the first shelf 104, and the second shelf 106 using tabs or other connection means. In one exemplary embodiment, the rack 102, the first shelf 104, and the second shelf 106 may be joined together using a non-fusion weld bond. It can be noted that the non-fusion weld bond may be accomplished by riveting, folding corners with tabs, and other connection methods.

Further, the side walls 108 of the rack 102 may be integrated with the at least one handle 110, for lifting, attaching, mounting, or detaching the cordless tool holding apparatus 100 from a base. In one embodiment, the base may be a wall. Such use of the at least one handle 110 may facilitate a user to avoid mishandling the cordless tool holding apparatus 100 or avoid getting hurt by lifting the cordless tool holding apparatus 100 from edges. In one embodiment, the at least one handle 110 may be made of a soft material, to provide comfort to the user, while lifting the cordless tool holding apparatus 100. In one exemplary embodiment, the side walls 108 may include a plurality of handles. In one embodiment, the at least one handle 110 may be provided for transporting the cordless tool holding apparatus 100 from one place to another. Further, the at least one handle 110 may provide a method for affixing the rack 102 in storage carousels. In one embodiment, the at least one handle 110 may provide a method of affixing the rack 102 in an automated storage and retrieval systems (ASRS) using a plurality of quick connection clamps or levers. Further, the at least one handle 110 may provide a method of affixing the rack 102 in the ASRS using a strap or tool-belt, which facilitates a use of quick connection clamps or levers. In one example embodiment, the use of quick clamps allow connection to 5 gallon buckets. In another embodiment, the at least one handle 110 may provide a connection mechanism for the rack 102 to couple buckets, containers and alike onto the at least one handle 110. In one embodiment, the at least one handle 110 may be carved on the side walls 108, with a curved grip for easy handling of the cordless tool holding apparatus 100.

In one embodiment, the at least one handle 110 may be a cutout portion on the side walls 108 of the rack 102. It can be noted that the cutout portion may allow the user to lift or hold or attach the rack as desired using hands or fingers or belts. In one exemplary embodiment, the at least one handle 110 may be provided with a belt clip, which may allow the ability to hang tools on the at least one handle 110. It can be noted that, the belt clip may be coupled into the cutout portion to hold the cordless tool using the snap-fit assembly 114. In one embodiment, the at least one handle 110 may include a security bar accessory.

In an embodiment, the at least one handle 110 may be covered with a rubber grip to provide comfort to the hands of the user, during lifting and carrying the rack 102. In an exemplary embodiment, the rack 102 may be provided with at least two handles integrated on both sides of the rack 102. In another embodiment, the at least one handle 110 and the rack 102 may be forged as a single unit. In another embodiment, the at least one handle 110 may be made from a material selected from a group of materials including stainless steel, alloy steel, and any possible combination of materials that can withstand a load bearing capacity of the cordless tool holding apparatus 100.

The first shelf 104 may be coupled at a first end of the side walls 108. The second shelf 106 may be coupled at a second end of the side walls 108. In one embodiment, the first shelf 104, the second shelf 106, and the side walls 108 may be coupled to each other to form the rack 102 having a pre-defined shape. In one example embodiment, the rack 102 is generally preferred to have the rectangular or the square shape (as shown in FIG. 1A). In one embodiment, the first shelf 104 may be parallel to the second shelf 106, in a transverse direction.

As shown in FIG. 1A, the second shelf 106 may comprise the plurality of extended portions 112. Further, the plurality of extended portions 112 may be extending longitudinally outwards from the second shelf 106 and may be parallel to the first shelf 104. In one exemplary embodiment, each extended portion 112 of the plurality of extended portions 112 may correspond to the tapered section 116 for the at least one snap-fit assembly 114. Further, each extended portion 112 may comprise the first plurality of holes 118 to be coupled with the second plurality of holes of the at least one snap-fit assembly 114. In one embodiment, the first plurality of holes 118 may be equally spaced apart from each other. In one embodiment, the first plurality of holes 118 may be spaced apart from each other at a predefined distance. In one exemplary embodiment, the first plurality of holes 118 may be spaced at least 1.75 inches apart from each other. In one embodiment, the first shelf 104 may facilitate holding a plurality of battery holders (not shown) using the another set of holes 120. In another embodiment, the first shelf 104 may facilitate holding at least one snap-fit assembly 114, using the another set of holes 120. In one embodiment, the second shelf 106 may facilitate holding a plurality of cordless tools, a plurality of corded tools, hand held tools, or other tools which may fix with a snap fit assembly. In one exemplary embodiment, the second shelf 106 may be configured to hold a plurality of hand-operated tools via a sleeve holster. In one exemplary embodiment, the second shelf 106 includes at least five extended portions.

The cordless tool holding apparatus 100 may further comprise the at least one snap-fit assembly 114. The at least one snap-fit assembly 114 may be coupled with each extended portion 112, using the plurality of screws into the first plurality of holes 118 of each extended portion 112 and the second plurality of holes of the at least one snap-fit assembly 114. Further, the first plurality of holes 118 may be configured to receive the plurality of screws (such as threaded screws), for holding the at least one snap-fit assembly 114 on the at least one surface of each extended portion 112. In one embodiment, the first plurality of holes 118 may be configured to hold the at least one snap-fit assembly 114 on the at least one surface of each extended portion 112, using rivets or any other attaching means. The at least one snap-fit assembly 114 may be configured to mount at least one cordless tool on the cordless tool holding apparatus 100. In one exemplary embodiment, the at least one snap-fit assembly 114 may also be referred to as a cordless tool holder or a battery receptacle receiver or a plastic tool mount. The detailed description of the snap-fit assembly 114 may be described later in conjunction with FIG. 2 and FIG. 3.

Figure 1C:
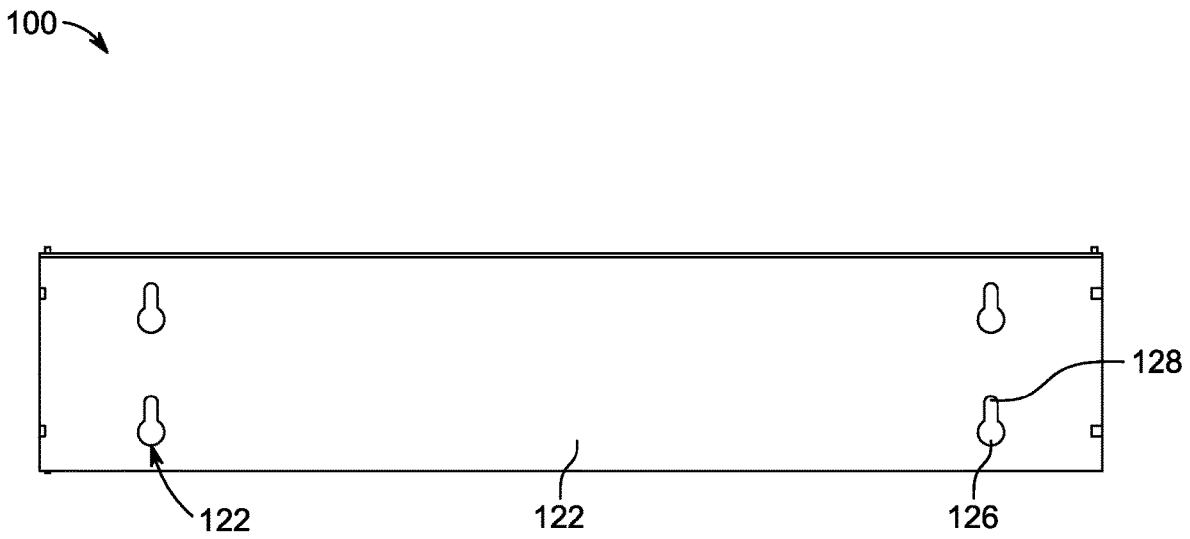
FIG. 1C illustrates a rear view of the cordless tool holding apparatus, according to an embodiment of the present disclosure.

As shown in FIG. 1C, the rack 102 may include a back wall 122. The back wall 122 may be coupled with the first shelf 104, the second shelf 106, and the side walls 108 of the rack 102. In an embodiment, the back wall 122 may be coupled with the first shelf 104, the second shelf 106, and the side walls 108 of the rack 102, using fusion welding along a perimeter of the back wall 122. In one exemplary embodiment, the back wall 122 may be coupled with the first shelf 104, the second shelf 106, and the side walls 108 of the rack 102, using non-fusion weld bonds. It can be noted that the non-fusion weld bond may be accomplished by riveting, folding corners with tabs, and other connection methods. Further, the back wall 122 may comprise a plurality of key holes 124 to mount the rack 102 onto the base or a wall. In an embodiment, the plurality of key holes 124 may be keyed or elongated or rectangular shaped. In one exemplary embodiment, the base or the wall may be a toolbox, a tool bucket, a tool belt, etc. In another exemplary embodiment, the key holes 124 may be provided to mount the rack 102 onto the toolbox or the tool bucket or the tool belt. In an alternate exemplary embodiment, the key holes 124 may be provided to mount the rack 102 inside of a truck bed storage using a plurality of bins or lids. Further, the ribs may be placed adjacent to the key holes 124, to provide insurance against loose screws. In addition, the ribs may rack 102 to separate from the base or the wall. Further, each key hole of the plurality of key holes 124 may comprise a circular section 126 and an elongated section 128. In one exemplary embodiment, the back wall 122 comprises four key holes. Further, each key hole of the plurality of key holes 124 may facilitate mounting the rack 102 to the base or the wall, using a mounting screw assembly 130 (as shown in FIG. 1E). In another alternate exemplary embodiment each key hole of the plurality of key holes 124 may comprise a rib integrated adjacent to each key hole 124. Further, the rib may be configured to hold the mounting screw assembly 130 retained within the base. In one exemplary embodiment, the rib may be provided to support the mounting screws assembly 130 onto the plurality of key holes 124 when mounted onto the base. In one alternate embodiment, each key hole of the plurality of key holes 124 may facilitate mounting the rack 102 to the base or the wall, using non-screw mounting means. It can be noted that non-screw mounting means may include abutments which may be provided with a snap that may stick out to connect to the base. Further, the circular section 126 may have a pre-defined diameter based on the size of the mounting screw assembly 130, to be used for mounting the rack 102 on the base or the wall. In one embodiment the circular section 126 may have the diameter less than the diameter of the mounting screw assembly 130. Further, the elongated section 128 may facilitate the mounting screw assembly 130 to be held firmly by the plurality of key holes 124. Such use of the plurality of key holes 124 may assist in detachably mounting the cordless tool holding apparatus 100 on the base or the wall.

Figure 1D:
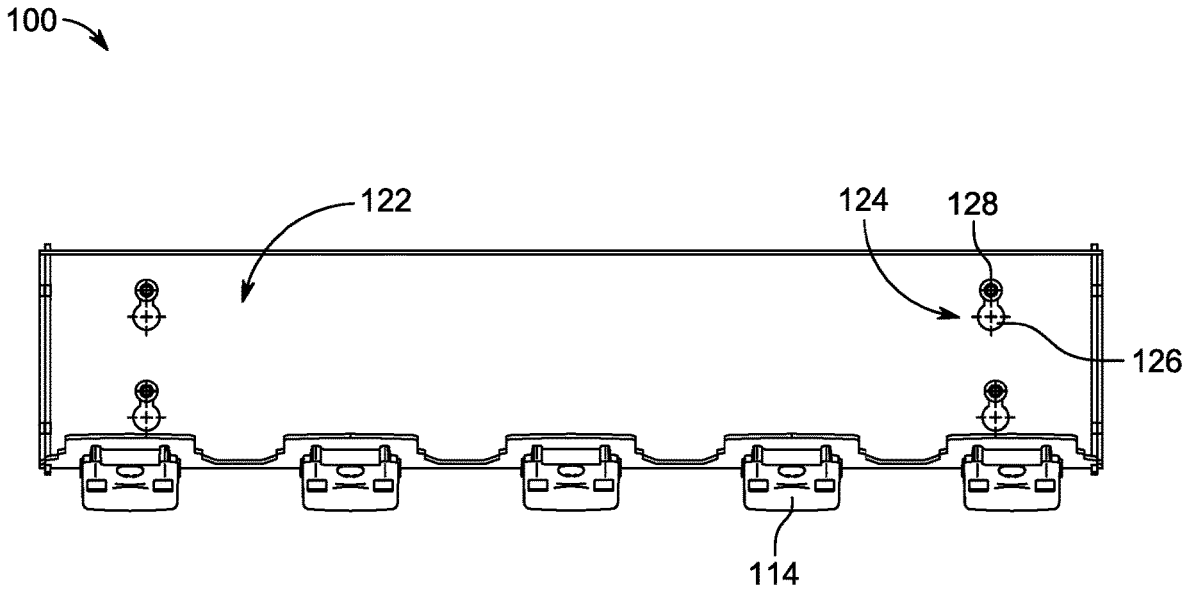
FIG. 1D illustrates a rear view of the cordless tool holding apparatus coupled with at least one snap-fit assembly, according to an embodiment of the present disclosure.
Figure 1E:
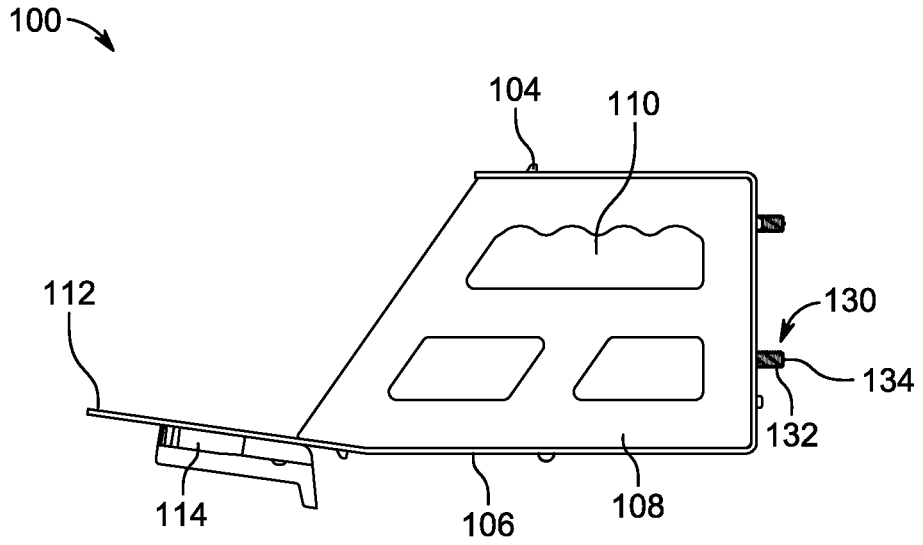
FIG. 1E illustrates a side view of the cordless tool holding apparatus, according to an embodiment of the present disclosure.

As shown in FIG. 1D, the rack 102 may comprise the back wall 122. Further, the back wall 122 may comprise the plurality of key holes 124 to mount the rack 102 on a base or a wall. Further, each key hole of the plurality of key holes 124 comprises the circular section 126 and the elongated section 128. In one exemplary embodiment, the back wall 122 comprises four key holes 126. Further, each key hole of the plurality of key holes 124 may facilitate to mount the rack 102 to the base or the wall. Further, the elongated section 128 may facilitate the mounting screw 134 to be held firmly by the plurality of key holes 124. In an exemplary embodiment, the diameter of the circular section 126 may be twice the diameter of the elongated section 128. Such use of the plurality of key holes 124 may assist in detachably mounting the cordless tool holding apparatus 100 on the base or the wall. Further, as shown in FIG. 1D, in one exemplary embodiment, at least five cordless tools may be coupled with the rack 102, in the single in-line stack configuration.

As shown in FIG. 1E, the mounting screw assembly 130 may comprise a mounting clip 132 and a mounting screw 134. Further, the mounting clip 132 may be inserted into the circular portion 128, for firmly mounting the cordless toll holder apparatus 100 on the base. In one embodiment, the base may be a wall. In an embodiment, the mounting clip 132 may be a small hollow cylindrical section and threaded on an inner side to receive the mounting screw 134. Further, the mounting screw 134 may be inserted into the mounting clip 132 for affixing the cordless tool holding apparatus 100 on the base or wall. In an embodiment, the mounting clip 132 may be coupled with the mounting screw 134, in a manner, that the mounting screw 134 may be placed at a front side of each key hole of the plurality of the key holes 126 and the mounting clip 132 may be placed at a rear side of each key hole of the plurality of the key holes 126. In one embodiment, the mounting screw 134 may be then tightened into the mounting clip 132 through each key hole of the plurality of the key holes 126 using a screwdriver. In another embodiment, the mounting clip 132 may be embedded into the hole of a wooden surface, and then the mounting screw 134 may be tightened into the mounting clip 132 through each key hole of the plurality of the key holes 126. In an exemplary embodiment, at least four mounting screws may be provided for mounting the rack 102 onto the base. In one embodiment, the mounting clip 132 may be made from a material selected from a group of materials including plastic, polymer, and alike. In one embodiment, the mounting screw 134 may be made from a material selected from a group of materials of stainless steel, alloy steel, brass, and any possible metal alloy to withstand a load of the rack 102 along with the cordless tools mounted on the rack 102.

FIG. 2 illustrates a sectional side view of the at least one snap-fit assembly 114 coupled with the at least one surface of each extended portion 112 of the plurality of extended portions 112 of the cordless tool holding apparatus 100. FIG. 2 is described in conjunction with FIGS. 1A-1E. In one embodiment, the at least one snap-fit assembly 114 comprises a second plurality of holes 202 to couple to the first plurality of holes 118 of the at least one surface of each extended portion 112, using a plurality of screws 204. In one example embodiment, the at least one snap-fit assembly 114 comprises the second plurality of holes 202 to couple to the first plurality of holes 118 of the at least one surface of each extended portion 112 using a plurality of rivets. In another example embodiment, the at least one snap-fit assembly 114 may be configured to couple with the at least one surface of each extended portion 112 using a snap-fit arrangement or rivets, eliminating the use of screws. In one embodiment, the second plurality of holes 202 may be located at the center of the at least one snap-fit assembly 114. In one embodiment, the plurality of screws 204 may be threaded screws, for coupling the at least one snap-fit assembly 114 to the at least one surface of each extended portion 112 of the plurality of extended portions 112. Further, the second plurality of holes 202 may be equally spaced apart from each other. Further, the second plurality of holes 202 may be spaced at a pre-defined distance from each other. In one exemplary embodiment, the second plurality of holes 202 may be spaced at the least 1.75 inches apart from each other. In one embodiment, the second plurality of holes 202 may be threaded. The second plurality of holes 202 may be aligned to the first plurality of holes 118, when the at least one snap-fit assembly 114 is mounted on the at least one surface of each extended portion 112. Further, the second plurality of holes 202 may be made from a material selected from a group of materials including stainless steel, alloy steel, carbon fiber, and plastic.

Figure 3:
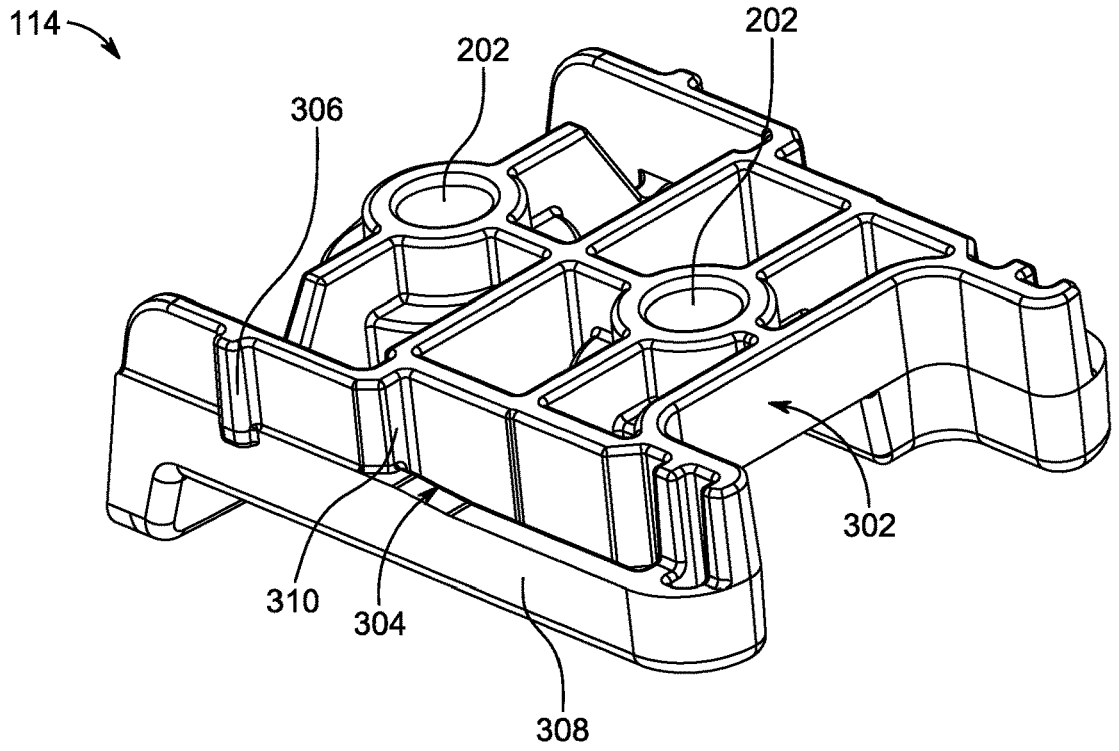
FIG. 3 illustrates an isometric view of the snap-fit assembly, according to an embodiment of the present disclosure.

FIG. 3 illustrates an isometric view of the at least one snap-fit assembly 114 to be coupled with the at least one surface of each extended portion 112 of the plurality of extended portions 112 of the cordless tool holding apparatus 100. FIG. 3 is described in conjunction with FIGS. 1A-1E and FIG. 2. The at least one snap-fit assembly 114 may be referred as a tool holder or a receptacle or a plastic tool mount. The at least one snap-fit assembly 114 may comprise a body 302, at least one ramp 304, and at least one rib 306. Further, the at least one ramp 304 and the at least one rib 306 may be integrated on the body 302 of the at least one snap-fit assembly 114. In one embodiment, the at least one ramp 304 may be integrated on at least one side 308 of the at least one snap-fit assembly 114. In another embodiment, another ramp (not shown) may be integrated on another side of the at least one snap-fit assembly 114. Further, the at least one ramp 304 may be a protruded portion extending outwards from the at least one side 308 of the snap-fit assembly 114. Further, the at least one snap-fit assembly 114 may comprise a ramp-break 310 integrated at an end of the at least one ramp 304. Further, the ramp-break 310 may be integrated on the at least one side 308 of the at least one snap-fit assembly 114. In one embodiment, the ramp-break 310 may be an end wall of the at least one ramp 304 and may be employed when a base section of the at least one cordless tool may be engaged with the at least one ramp 304. Further, the ramp-break 310 may allow the base section of the at least one cordless tool, to be pushed over the ramp break 310, and thereby side walls of the base section of the at least one cordless tool move further and couple with the at least one rib 306.

In one embodiment, the at least one rib 306 may be integrated on at least one side 308 of the at least one snap-fit assembly 114. In another embodiment, another rib (not shown) may be integrated on another side of the at least one snap-fit assembly 114. Further, the at least one rib 306 may be protruded from the at least one side 308 of the snap-fit assembly 114. The at least one rib 306 may be used as a locking mechanism for providing a snap-fit locking feature, by receiving the side walls of the base section of the at least one cordless tool, after being pushed over the ramp break 310, to securely lock the at least one cordless tool.

Further, the at least one snap-fit assembly 114 may comprise the second plurality of holes 202 to couple to the first plurality of holes 118 of the at least one surface of each extended portion 112 of the plurality of extended portions 112, using the plurality of screws 204. Further, the second plurality of holes 202 may be integrated on the body 302 of the at least one snap-fit assembly 114. In an embodiment, the at least one snap-fit assembly 114 may be configured to receive at least one of cordless tool having any number of variations in shape, and size. In an embodiment, the at least one snap-fit assembly 114 may be configured to securely lock multiple cordless tools of different sizes. In one embodiment, the at least one snap-fit assembly 114 may be configured to be stacked in a single or in-line configuration. In another embodiment, two snap-fit assemblies may be configured to be stack in a double stack configuration, as explained in FIG. 5A and FIG. 5B.

In one exemplary embodiment, the at least one snap-fit assembly 114 may be provided with at least two ramps and at least two ribs. Further, the at least two ramps are configured to be received between the sidewalls of the base section of the at least one cordless tool. Further, the at least two ribs are configured to provide a snap-fit locking feature, by locking the cordless tool in a static, and a secure manner. In an embodiment, the at least one snap-fit assembly 114 may be made from a material selected from a group of materials including stainless steel, wood, alloy steel, or plastic.

Figure 4:
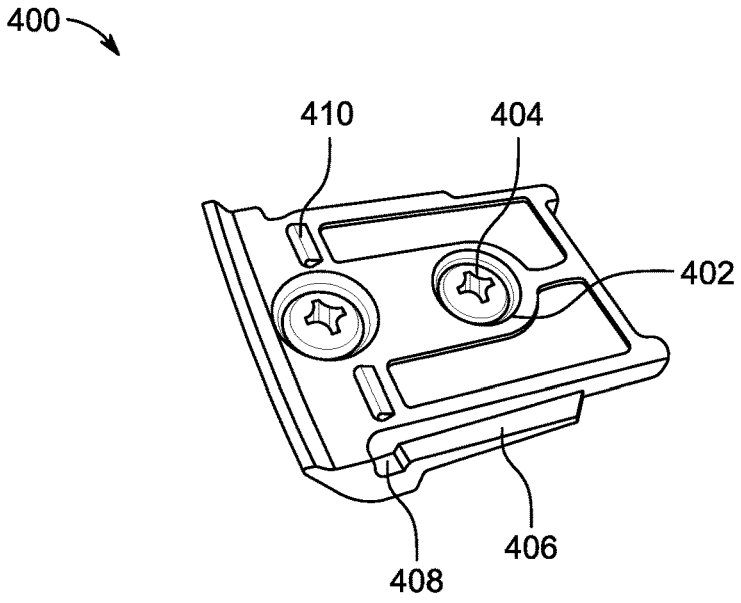
FIG. 4 illustrates an exemplary snap-fit assembly with a pair of screws, according to an embodiment of the present disclosure.

FIG. 4 illustrates an exemplary embodiment showing a snap-fit assembly 400, according to an embodiment of the present disclosure. The snap-fit assembly 400 includes a plurality of holes 402 to receive a plurality of screws 404. In an embodiment, the snap-fit assembly 400 may include a plurality of ramps 406 integrated on both sides of the snap-fit assembly 400. Further, each ramp 406 of the plurality of ramps 406 may be configured to be received or engaged with the side wall of the base section of the at least one cordless tool. In one embodiment, each ramp 406 of the plurality of ramps 406 may be a protruded section on the snap-fit assembly 400. In an embodiment, each ramp 406 of the plurality of ramps 406 may be configured to push the side wall of the cordless tool for a secure locking mechanism. Further, the snap-fit assembly 400 may include an end groove 408 integrated at both sides of the ramp 404. In one embodiment, the end groove 408 may be a curved cavity, so that at least one cordless tool when engaged into the snap-fit assembly 400, may get easily incorporated into the end groove 408. In an embodiment, the end groove 408 may serve a function of disengaging or detaching the cordless tool easily from the snap-fit assembly 400.

As shown in FIG. 4, the snap-fit assembly 400 may comprise a plurality of ribs 410 into which an end clip (not shown) of the base section of the at least one cordless tool may be engaged. In one embodiment, each rib of the plurality of ribs 410 may provide a snap-fit locking feature, by receiving a battery clip or an end clip of the at least one cordless tool. In one embodiment, the plurality of ribs 410 may be disposed on a top surface of the snap-fit assembly 400. Further, each rib may facilitate a locking function, when the end clip of the at least one cordless tool may get engaged into the curved groove 408 of the ramp. In another embodiment, the plurality of ribs 410 may be integrated on the top surface of the snap-fit assembly 400 on either sides of a first hole from the plurality of holes 402. In an embodiment, the plurality of ramps 404, the plurality of ribs 408, and the snap-fit assembly 400 may be forged as a single unit.

Figure 5A:
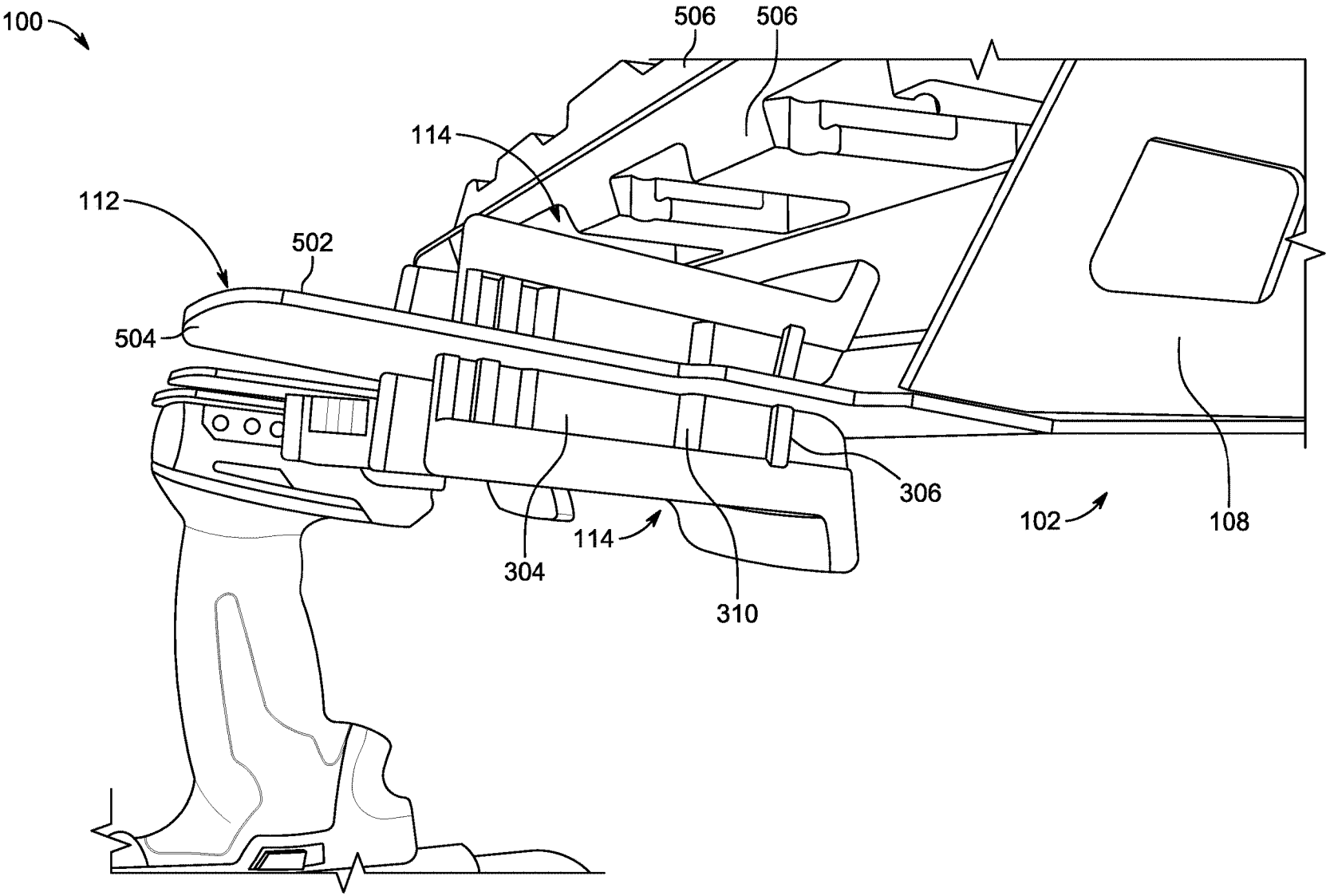
FIG. 5A illustrates a side view of the cordless tool holding apparatus 100 with two snap-fit assemblies coupled in a double stack configuration, according to an embodiment of the present disclosure.
Figure 5B:
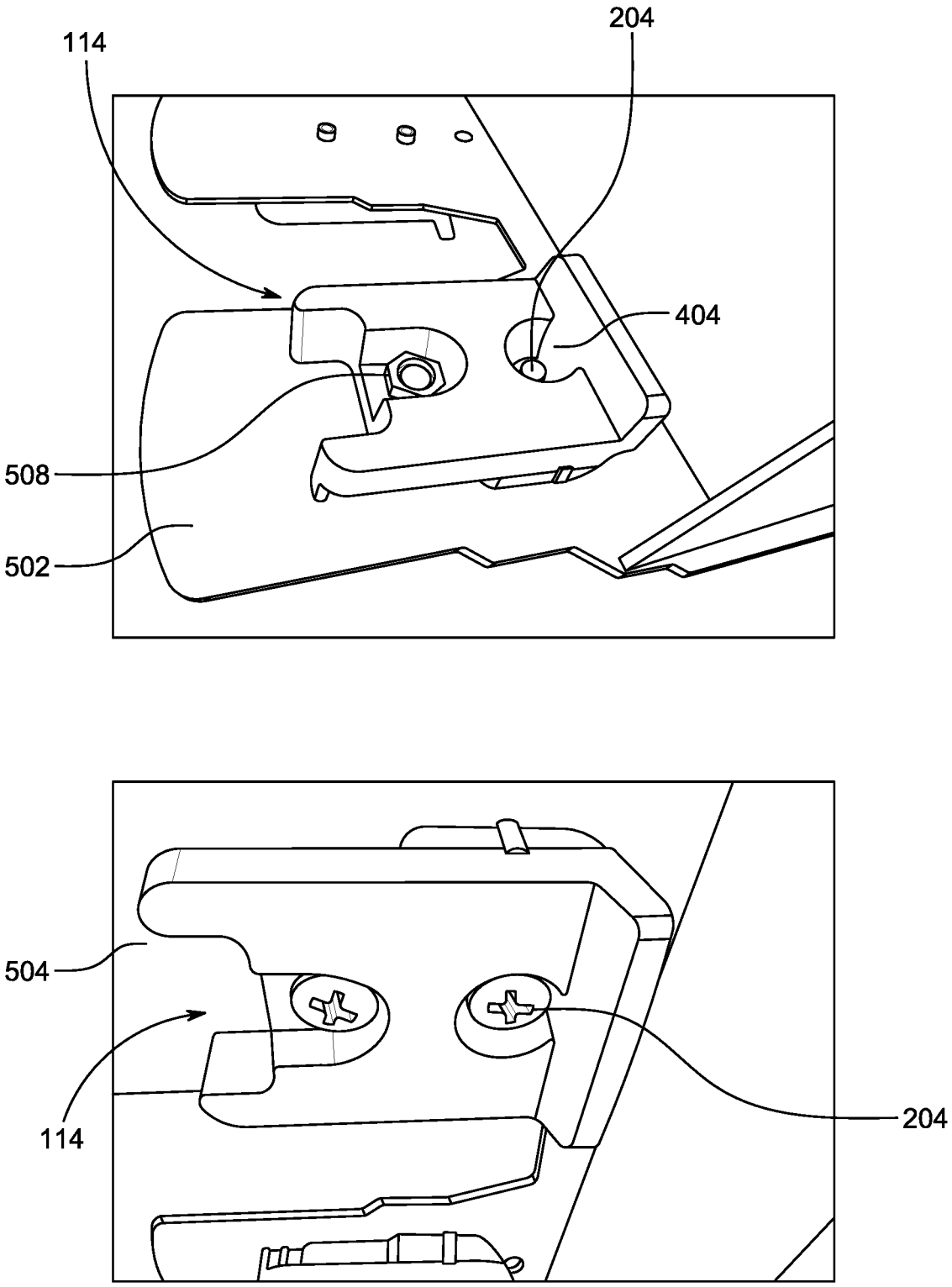
FIG. 5B illustrates two snap-fit assemblies coupled in double stack configuration over each extended portion, according to an embodiment of the present disclosure.

FIG. 5A illustrates a side view of the cordless tool holding apparatus 100 with two snap-fit assemblies 114 coupled in the double stack configuration. It can be noted that FIG. 5A may be described in conjunction with FIGS. 1A-1E, FIG. 2, FIG. 3, FIG. 5B-5E, and FIG. 7. In one embodiment, the at least one snap-fit assembly 114 may be coupled at each extended portion 112 of the plurality of extended portions 112 using the plurality of screws 204 (as shown in FIG. 5B). Further, the plurality of screws 204 may be embedded on bottom side of a first snap-fit assembly 114 via the second plurality of holes 202 of the first snap-fit assembly 114, and the plurality of screws 204 may be received into the second plurality of holes 202 of a second snap-fit assembly 114 via the first plurality of holes 118. Further, each extended portion 112 of the plurality of extended portions 112 may comprise a first surface 502 and a second surface 504. In one embodiment, the double stack configuration may enable stacking the first snap-fit assembly 114 on the first surface 502 of each extended portion 112 of the plurality of extended portions 112 and stacking the second snap-fit assembly on the second surface 504 of each extended portion 112 of the plurality of extended portions 112.

Further, the first snap-fit assembly 114 and the second snap-fit assembly 114 may comprise the at least one ramp 304, the at least one ramp-break 310 and at least one rib 306. In one embodiment, the at least one ramp 304 may be configured to receive the at least one cordless tool 510 (as shown in FIG. 5E). In one embodiment, the double stack configuration may facilitate coupling two snap-fit assemblies 114 at each extended portion 112 of the plurality of extended portions 112. In one embodiment, in double stack configuration the second snap-fit assembly 114 may be coupled at each extended portion 112 from the first surface 502. In one embodiment, the first snap-fit assembly 114 and the second snap-fit assembly 114 may be coupled to each extended portion 112 using the plurality of screws 204 through the second plurality of holes 202 of the first snap-fit assembly and the second snap-fit assembly via the first plurality of holes 118 of each extended portion 112. Further, the first shelf 104 of the rack 102 may be provided with the another set of holes 120 which may be configured to facilitate holding a plurality of battery holders 506 using the another set of holes 120. In another embodiment, the first shelf 104 may facilitate holding at least one snap-fit assembly 114, using the another set of holes 120.

FIG. 5B illustrates two snap-fit assemblies 114 coupled in double stack configuration over each extended portion 112, according to an embodiment of the present disclosure. FIG. 5B is described in conjunction with FIGS. 1A-1E, FIG. 2, FIG. 3, FIG. 5A-5E, and FIG. 7. In one embodiment, the first snap-fit assembly 114 and the second snap-fit assembly 114 may comprise the second plurality of holes 202. In one exemplary embodiment, the second snap fit assembly 114 may be placed over the first surface 502 of each extended portion 112 of the plurality of extended portions 112, and the first snap-fit assembly 114 may be held with the second surface 504 and a screw of the plurality of screws 204 may be tightened through a hole of the second plurality of holes 202 of the first snap-fit assembly 114 into an another hole of the second plurality of holes 202 of the second snap-fit assembly 114 via a hole of the first plurality of holes 118 on the extended portion 112.

Further, the screw of the plurality of screws 204 may be tightened by a plurality of nuts 508 on the first surface 502 of each extended portion 112. In one embodiment, one nut of the plurality of nuts 508 may be placed over a hole of the second plurality of holes 202 of the second snap-fit assembly 114 and may be tightened into the screw using a common wrench. In one embodiment, the plurality of nuts 508 may be used on the second snap-fit assembly 114 to tighten the plurality of screws 204. In one embodiment, the plurality of screws 204 and the plurality of nuts 508 may be threaded. In one exemplary embodiment, a plurality of nuts 508 may be used for tightening the two snap-fit assemblies 114 onto each extended portion 112 of the plurality of extended portion 112. In another exemplary embodiment, at least two threaded nuts and at least two threaded screws are provided to couple the two snap-fit assemblies 114 at each extended portion 112.

Figure 5C:
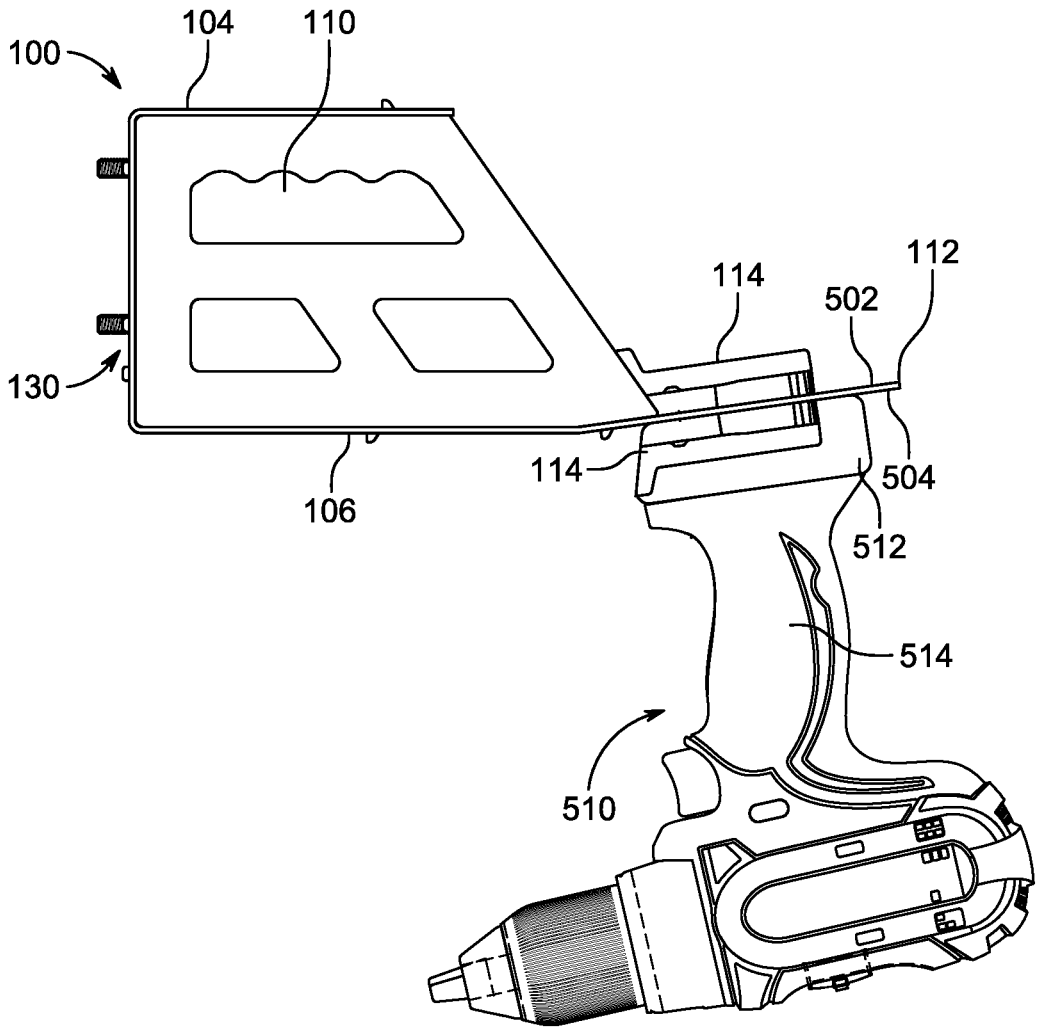
FIG. 5C illustrates a side view of the cordless tool holding apparatus, holding a cordless tool, according to an embodiment of the present disclosure.
Figure 5D:
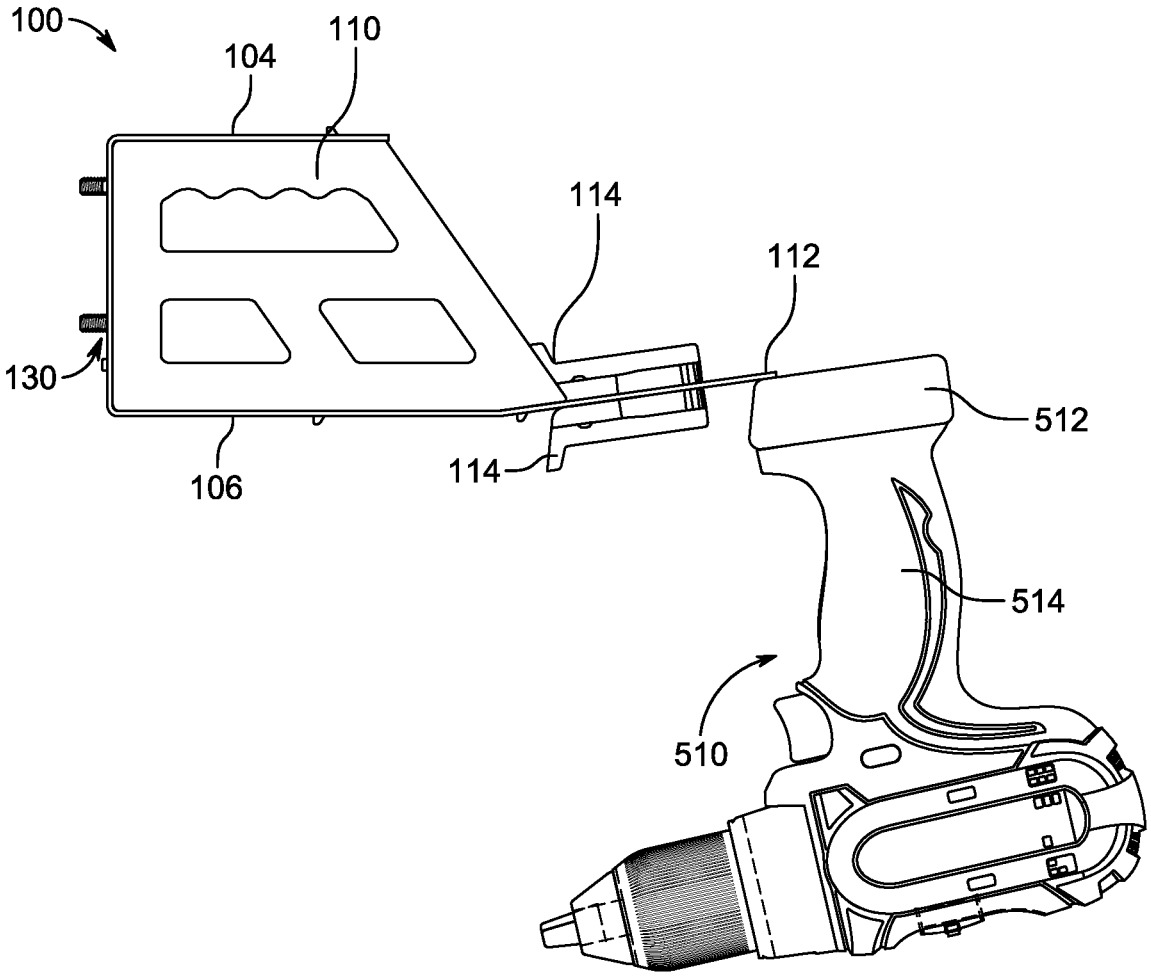
FIG. 5D illustrates the side view of the cordless tool holding apparatus, holding the cordless tool, according to another embodiment of the present disclosure.
Figure 5E:
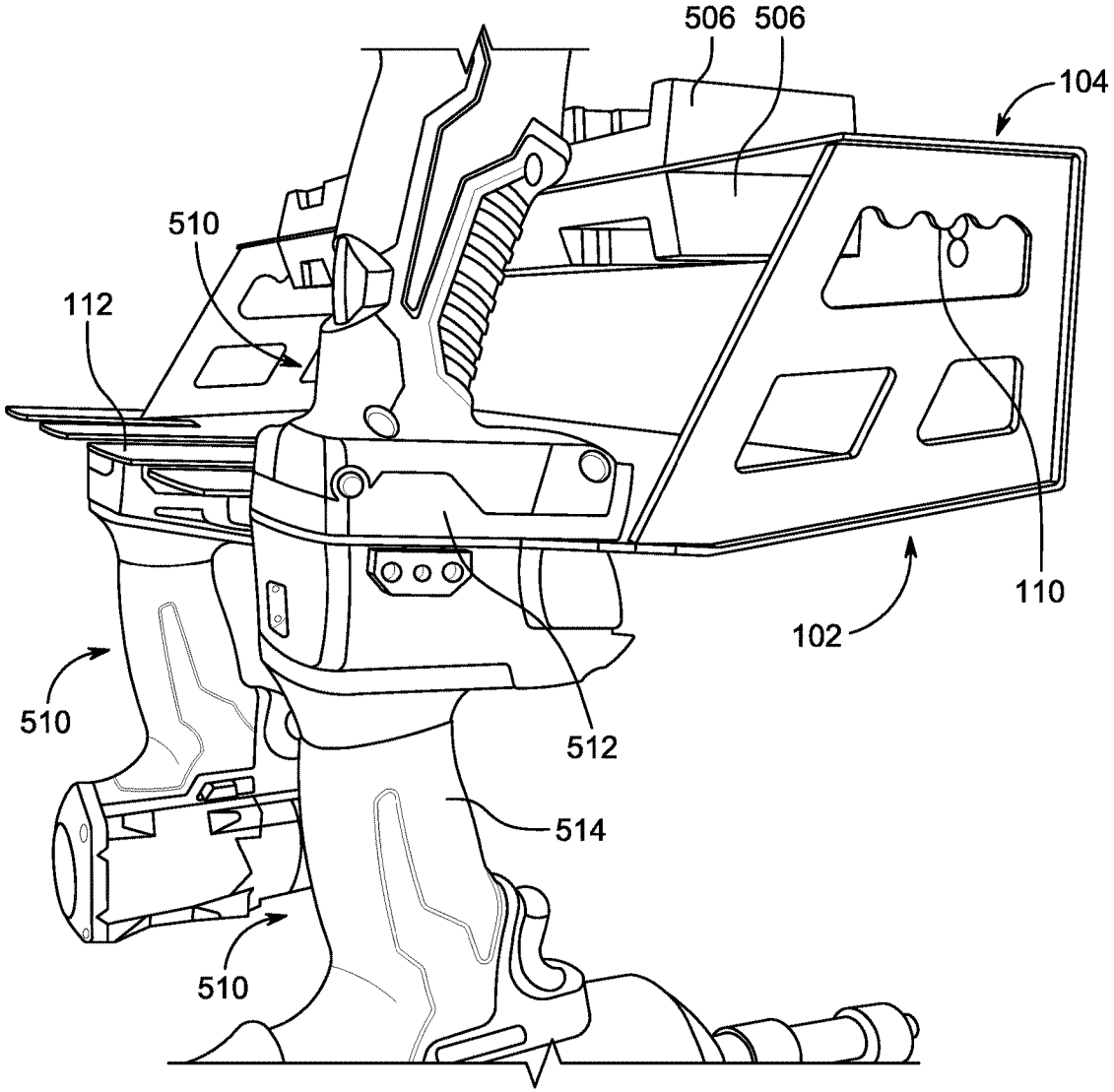
FIG. 5E illustrates the cordless tool holding apparatus holding two cordless tools in the double stack configuration, according to an embodiment of the present disclosure.

FIG. 5C and FIG. 5D illustrate a side view of the cordless tool holding apparatus 100, holding a cordless tool 510, according to an embodiment of the present disclosure. FIG. 5A and FIG. 5B are described in conjunction with FIGS. 1A-1E, FIG. 2, FIG. 3, and FIG. 5A-5B. In one embodiment, the cordless tool holding apparatus 100 may comprise the first shelf 104 and the second shelf 106 spaced apart along a transverse direction. Further, the first shelf 104 and the second shelf 106 may be parallel along the transverse direction. In one exemplary embodiment, the first shelf 104, the second shelf 106 and the back wall 122 may form the rack 102 of generally preferred rectangular shape. Further, the rectangular shape may be referred as a box which may be a semi-enclosed or open from front side of the rack 102. In one embodiment, the box may be configured to store keys, battery testers, hex keys, chuck keys, flashlights, manuals for cordless tools, warranty guides for the cordless tools, without departing from the scope of the disclosure. FIG. 5C illustrates the cordless tool holding apparatus 100 holding the cordless tool 510, in an engaged position. The cordless tool 510 may comprise a base section 512 and a handle 514. Further, the cordless tool holding apparatus 100 may include the at least one snap-fit assembly 114, and as illustrated in FIG. 5C. In one embodiment, the cordless tool 510 may be configured to be coupled with the at least one snap-fit assembly 114, by engaging the at least one ramp 304 and the at least one rib 306 (as shown in FIG. 3) with the base section 512 of the cordless tool 510, as described above. In one exemplary embodiment, the cordless tools 510 may be referred as tools with large dimensions, such as reciprocating saws, without departing from the scope of the disclosure. In one embodiment, the base section 512 of the cordless tool 510 may be referred as a cordless tool bottom. In one embodiment, the base section 512 of the cordless tool 510 may use an adapter, configured to hold batteries. Further, the base section 512 may include a battery receptacle (not shown) which may be received by the at least one ramp 304 and the at least one rib 306 of the at least one snap-fit assembly 114. In one embodiment, the at least one snap-fit assembly 114 is coupled with the at least one surface of each extended portion 112 of the plurality of extended portions 112 of the rack 102, in a double stack configuration. In one embodiment, the plurality of extended portions 112 may be able to mount a plurality of cordless tools in a single or in-line configuration. In another embodiment, the plurality of extended portions 112 may be able to mount the plurality of cordless tools in a double stack configuration.

Further, FIG. 5D illustrates the cordless tool holding apparatus 100 holding the cordless tool 510, in a disengaged position. In one embodiment, as shown in FIG. 5B, the cordless tool 510 may be disengaged or detached from the at least one snap-fit assembly 114, by simply pulling the handle 514 rearwards. In one embodiment, the at least one snap-fit assembly 114 may be easy to use for all kinds of cordless tools. In one embodiment, all variations of cordless tools may be coupled with the at least one snap-fit assembly 114. In another embodiment, in a double stack configuration, the cordless tool holding apparatus 100 may include a first snap-fit assembly 114 coupled at the first surface 502 of each extended portion 112 of the plurality of extended portions 112, and the second snap-fit assembly 114 coupled at the second surface 504 of each extended portion 112 of the plurality of extended portions 112.

FIG. 5E illustrates the cordless tool holding apparatus 100 holding two cordless tools 510 in the double stack configuration. FIG. 5E is described in conjunction with FIGS. 1A-1E, FIG. 2, FIG. 3, and FIG. 5A-5D. The double stack configuration may facilitate coupling two snap-fit assemblies 114 at each extended portion 112 of the plurality of extended portions 112. In one embodiment, in double stack configuration the second snap-fit assembly 114 may be coupled at each extended portion 112 from the first surface 502 and the first snap-fit assembly 114 may be coupled from the second surface 504. In one embodiment, the first snap-fit assembly 114 and the second snap-fit assembly 114 may be coupled to each extended portion 112 using the plurality of screws 204 through the second plurality of holes 202 of the first snap-fit assembly 114 and the second snap-fit assembly 114 via the first plurality of holes 118 of each extended portion 112. Further, the first shelf 104 of the rack 102 may be provided with the another set of holes 120 which may be configured to facilitate holding the plurality of battery holders 506 using the another set of holes 120. In another embodiment, the first shelf 104 may facilitate holding at least one snap-fit assembly 114, using the another set of holes 120. In one embodiment, each cordless tool 510 may be engaged and disengaged from each snap-fit assembly 114 by simply pushing and pulling each cordless tool 510 over each snap-fit assembly 114, as described in FIG. 5C and FIG. 5D. In one embodiment, the engagement of each cordless tool 510 allows engaging the at least one ramp 304 and the at least one rib 306 (as shown in FIG. 3) with the base section 512 of each cordless tool 510. In one embodiment, the plurality of battery holders 506 may be coupled with the first shelf 104 in the double stack configuration.

Figure 5F:
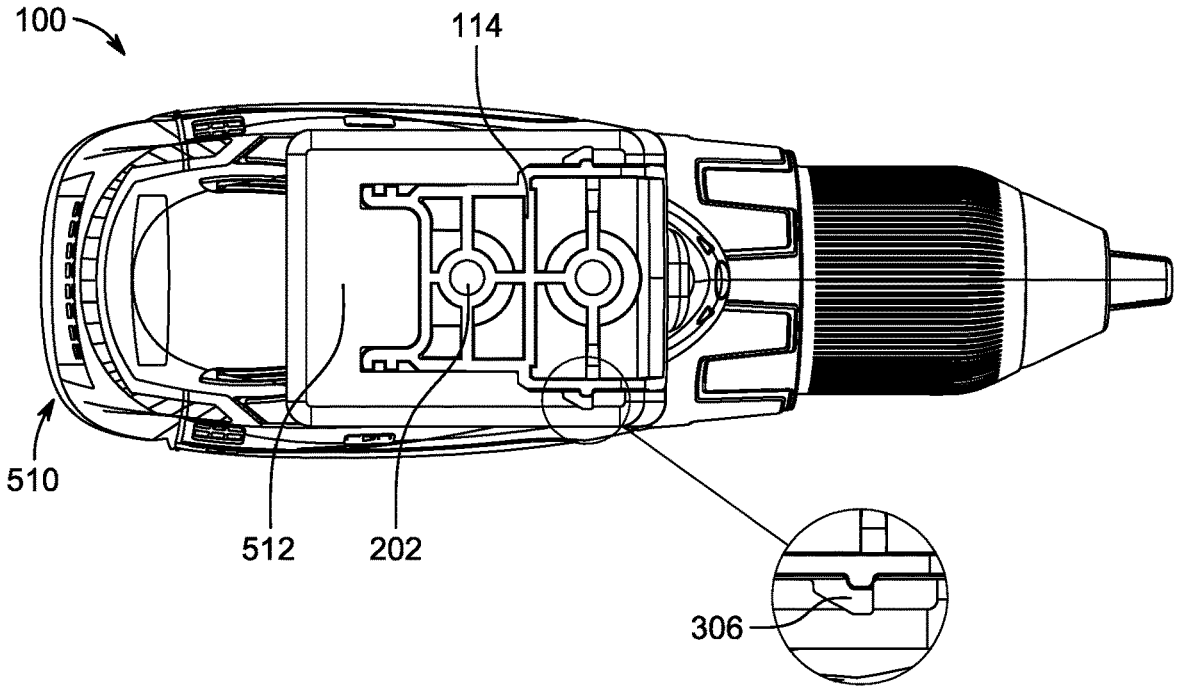
FIG. 5F illustrates a bottom view of the cordless tool holding apparatus, holding the cordless tool, according to an embodiment of the present disclosure.

FIG. 5F illustrates a bottom view of at least one snap-fit assembly 114 engaged with the cordless tool 510, according to an embodiment of the present disclosure. FIG. 5C is described in conjunction with FIGS. 1A-1E, FIG. 2, FIG. 3, and FIGS. 5A-5E. The at least one snap-fit assembly 114, with the at least one rib 306 (as shown in FIG. 3), may engage the base section 512 of the cordless tool 510, in a manner such that the at least one rib 306 (enlarged section in FIG. 5C) on either sides of the snap-fit assembly 114, create a pressure on the side walls of the base section 512 of the cordless tool 510, by pushing them transversely. Further, the pressure created, securely locks the base section 512 of the cordless tool 510 and thus the cordless tool 510, into the at least one rib 306 of the snap-fit assembly 114. Further, the use of the at least one rib 306 of the snap fit assembly 114, allows a snap-fit of the cordless tool 510 on the cordless tool holding apparatus 100. In an embodiment, the mechanism of engaging and disengaging the cordless tool 510, from the rack 102, is more user-friendly, than locking the cordless tools using conventional clips or locks, and then a lot of time is taken during unlocking process. Therefore, the cordless tool holding apparatus 100 saves a lot of time and space, and also securely locks cordless tools in a more efficient manner.

Figure 6:
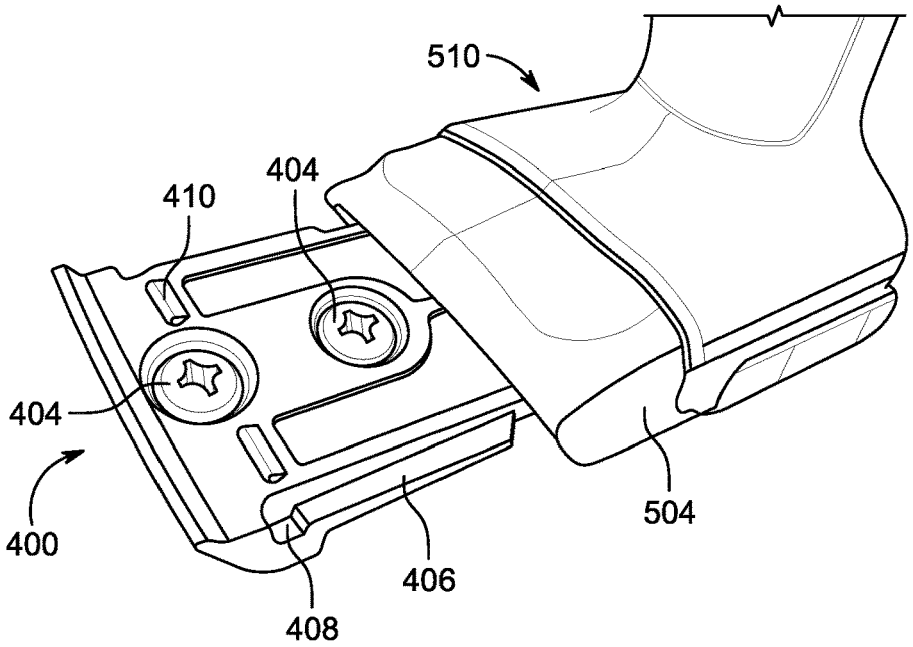
FIG. 6 illustrates the exemplary snap-fit assembly with a battery clip of a cordless tool, according to an embodiment of the present disclosure.

Further, FIG. 6 illustrates an exemplary embodiment of the snap-fit assembly 400 engaged with the cordless tool 510. FIG. 6 is described in conjunction with FIGS. 1A-1E, FIG. 2, FIG. 3, FIG. 4, and FIGS. 5A, 5B, 5C, 5D, 5E, and 5F. The snap-fit assembly 400 includes the plurality of holes 402 to receive the plurality of screws 404. In an embodiment, the snap-fit assembly 400 may include the plurality of ramps 406 integrated on both sides of the snap-fit assembly 400. Further, each ramp 406 of the plurality of ramps 406 may be configured to be received or engaged with the side walls of the base section 512 of the cordless tool 510. In one embodiment, each ramp 406 of the plurality of ramps 406 may be a protruded section on the snap-fit assembly 400. In an embodiment, each ramp 406 of the plurality of ramps 406 may be configured to push the side wall of the base section 512 of the cordless tool 510 for a secure locking mechanism. Further, the snap-fit assembly 400 may include the end groove 408 integrated at both sides of the snap-fit assembly 400 at the end of each ramp 406 of the plurality of ramps 406. In one embodiment, the end groove 408 may be a curved cavity, so that the base section 512 of the cordless tool 510, when engaged into the snap-fit assembly 400, may get easily incorporated into the end groove 408. In an embodiment, the end groove 408 may serve a function of disengaging or detaching the cordless tool easily from the snap-fit assembly 400.

Figure 7:
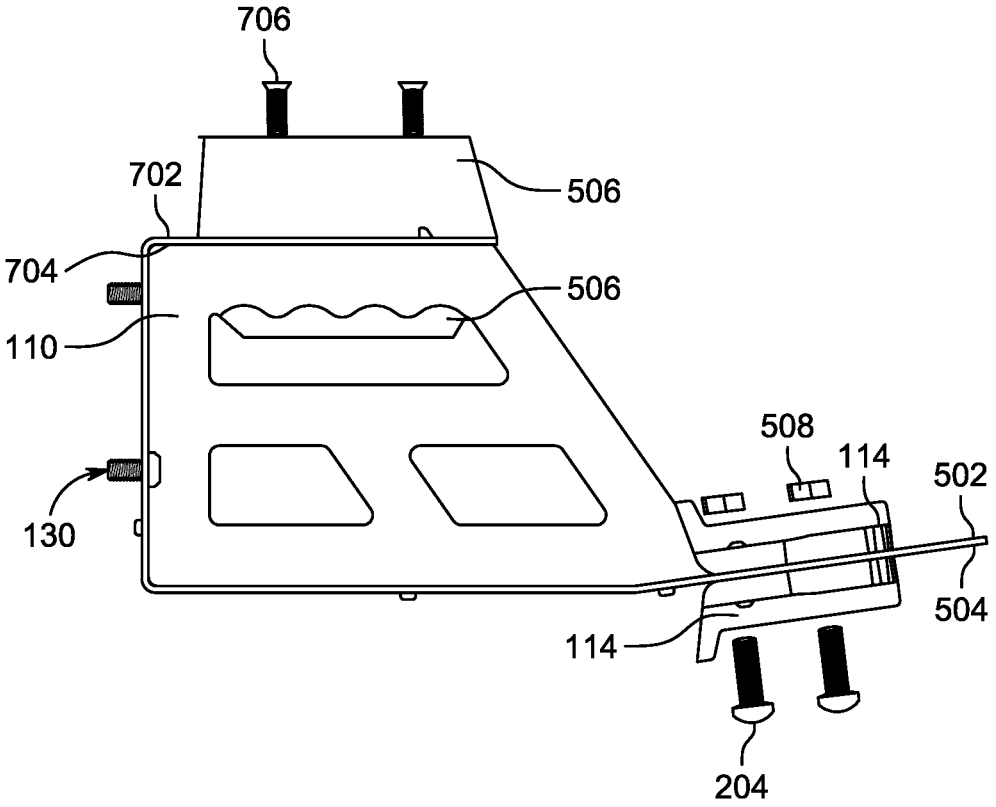
FIG. 7 illustrates the cordless tool holding apparatus with the double stack configuration of snap-fit assemblies coupled to the rack, according to an embodiment of the present disclosure.

FIG. 7 illustrates the double stack configuration of snap-fit assemblies 114 coupled to the rack 102, according to an embodiment of the present disclosure. FIG. 7 is described in conjunction with FIGS. 1A-1E, FIG. 2, FIG. 3, FIG. 4, and FIGS. 5A, 5B, 5C, 5D, 5E, and 5F. In one embodiment, the two snap-fit assemblies 114 may be coupled to each extended portion 112 of the plurality of extended portions 112. In one exemplary embodiment, the double stack configuration enables stacking one snap-fit assembly 114 on the first surface 502 of each extended portion 112 of the plurality of extended portions 112 and stacking another snap-fit assembly 114 on the second surface 504 of each extended portion 112 of the plurality of extended portions 112. In another embodiment, the first plurality of holes 118 of each extended portion 112 of the plurality of extended portions 112 may be coupled with the second plurality of holes 202 of the two snap-fit assemblies 114 using the plurality of screws 204. Further, each screw of the plurality of screws 204 may be provided to couple the two snap-fit assemblies 114, such that a first screw of the plurality of screws 204 may be embedded from a first hole 202 of a first snap-fit assembly 114 to be coupled with the second surface 504, into a first hole 118 of the first plurality of holes 118 of each extended portion 112. Further, each screw of the plurality of screws 204 may be received into a second hole 202 of a second snap-fit assembly 114 which may be placed on the first surface 502 of each extended portion 112. In one embodiment, each screw may be tightened using the nut 508. In one exemplary embodiment, the nut 508 may be threaded when each screw of the plurality of screws 204 may be threaded.

Further, the first shelf 104 of the rack 102 may be provided with the another set of holes 120 which may be configured to facilitate holding the plurality of battery holders 506 using the another set of holes 120. In another embodiment, the first shelf 104 may facilitate holding at least one snap-fit assembly 114, using the another set of holes 120. In one embodiment, the first shelf 104 may comprise a first surface 702 and a second surface 704. In one embodiment, the first surface 702 and the second surface 704 may be configured to hold the plurality of battery holders 506 using another set of screws 706. In one exemplary embodiment, each screw of the another set of screws 706 may be coupled from a first battery holder placed on the first surface 702 to a second battery holder at the second surface 704 of the first shelf 104.

In one alternate exemplary embodiment, the cordless tool holding apparatus 100 may comprise a rack 102 detachably mounted over a base through a plurality of key holes 124. Further, the rack 102 may be configured to hold a plurality of cordless tools. Further, the cordless tool holding apparatus 100 may comprise a snap-fit assembly 114 may be coupled with the rack 102, for locking the plurality of cordless tools. Further, the snap-fit assembly 114 may include a plurality of ramps 304 disposed on either sides of the snap-fit assembly 114, and a plurality of ribs 306 disposed on either sides of the snap-fit assembly 114 along a transverse direction of the snap-fit assembly 114. Further, the snap-fit assembly 114 may be configured to securely lock the plurality of cordless tool by engaging the plurality of ribs 306, and the plurality of ramps 304 into each of the plurality of cordless tool.

In another alternate exemplary embodiment, a snap-fit joint provided by the at least one snap-fit assembly 114 may be a simple, economical and quick way of connecting two parts. Further, the snap joints may be used in the invention to keep the wireless tools safe. In another alternate exemplary embodiment, the wireless or cordless tools are very beneficial as they make the work easier. A user may work easily without searching for the nearest power switch. Moreover, the wireless tools reduce the risk of injury due to electric shock. The wireless tools are also cost-effective as there is no need to repair or replace the wire. Further, the wireless tools mainly depend upon batteries. In another embodiment, the cordless tool holding apparatus 100 may be configured to provide a locking feature to securely lock or hold cordless tools using the at least one snap-fit assembly 114. Further, the cordless tool holding apparatus 100 may use an anti-theft cable to lock all tools and then mount over a wall using a nail, may store or lock or hold cordless tools in an orderly fashion.

In another alternate exemplary embodiment, the cordless tool holding apparatus 100 may be installed or mounted in all the positions that may include horizontal, vertical, or any other inclined position. Further, the hardware or mounting screws keeps the rack attached or mounted to the surface, and the snap-fit assembly protects the wireless or cordless tool from slipping out of the cordless tool holding apparatus 100, this helps to install the apparatus in any position.

In another alternate exemplary embodiment, the cordless tool holding apparatus 100 may help the user in storing and transporting the wireless tools without the risk of damage. Moreover, the user does not need to purchase different holders for variety of wireless tools like the cordless tool holding apparatus 100 has the capacity to hold different type of wireless tools irrespective of the shape and size of the wireless tools. It will be apparent to one skilled in the art that the above-mentioned components of the cordless tool holding apparatus 100 have been provided only for illustration purposes.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A cordless tool holding apparatus comprising:

a rack having:

a first shelf and a second shelf, the first shelf and the second shelf are configured to couple with each other via side walls of the rack, wherein the second shelf has a plurality of extended portions; and at least one snap-fit assembly coupled to at least one surface of each extended portion of the plurality of extended portions, wherein the at least one snap-fit assembly comprises:

a body;

at least one ramp coupled to the body and integrated on at least one side wall of the at least one snap-fit assembly, the at least one ramp is configured to receive a base section of at least one cordless tool; and at least one rib coupled to the body and integrated on the at least one side wall of the at least one snap-fit assembly, the at least one rib is configured to lock the base section after being received by the at least one ramp, wherein the at least one snap-fit assembly is configured to detachably couple the at least one cordless tool, with the at least one ramp and the at least one rib.

2. The cordless tool holding apparatus of claim 1, wherein each extended portion having a first plurality of holes for coupling to a second plurality of holes of the at least one snap-fit assembly, using a plurality of fasteners.

3. The cordless tool holding apparatus of claim 2, wherein the first plurality of holes is spaced at least 1.75 inches apart.

4. The cordless tool holding apparatus of claim 2, wherein the second plurality of holes is integrated within the body of the at least one snap-fit assembly.

5. The cordless tool holding apparatus of claim 1, wherein the at least one ramp couples with the base section of the at least one cordless tool, by receiving the at least one cordless tool into the at least one snap-fit assembly.

6. The cordless tool holding apparatus of claim 1, wherein the at least one ramp comprises a protruded portion extending outwards from a side of the at least one snap-fit assembly and is configured to receive side walls of the base section of the at least one cordless tool.

7. The cordless tool holding apparatus of claim 6, wherein the protruded portion pushes the side walls of the base section of the at least one cordless tool and retains the at least one cordless tool in place.

8. The cordless tool holding apparatus of claim 6, wherein at least one rib is integrated on an end of the at least one ramp, the at least one rib configured to securely lock the side walls of the base section of the at least one cordless tool.

9. The cordless tool holding apparatus of claim 1, wherein the at least one snap-fit assembly further comprises at least one ramp-break integrated at one end of the at least one ramp, and is configured to allow the base section of the at least one cordless tool to be pushed over the at least one rib.

10. The cordless tool holding apparatus of claim 1, wherein the at least one rib couples with a battery clip of the at least one cordless tool for a secure lock.

11. The cordless tool holding apparatus of claim 1, wherein the rack having a back wall, for coupling the first shelf, the second shelf, and the side walls of the rack.

12. The cordless tool holding apparatus of claim 11, wherein the back wall comprises a plurality of key holes, for mounting the rack.

13. The cordless tool holding apparatus of claim 12, wherein the plurality of key holes facilitates mounting the cordless tool holding apparatus using a mounting screw assembly.

14. The cordless tool holding apparatus of claim 13, wherein the mounting screw assembly comprises a mounting clip configured to receive a mounting screw, via at least one key hole of the plurality of key holes.

15. The cordless tool holding apparatus of claim 1, wherein two snap-fit assemblies are configured to be coupled to the extended portion of the rack in a double stack configuration.

16. The cordless tool holding apparatus of claim 15, wherein the double stack configuration facilitates coupling a first snap-fit assembly to a first surface of each extended portion and a second snap-fit assembly to a second surface of each extended portion, using a plurality of screws.

17. The cordless tool holding apparatus of claim 1, wherein the first shelf comprises a third plurality of holes to couple least one snap-fit assembly for mounting the at least one cordless tool.

18. The cordless tool holding apparatus of claim 1, wherein the first shelf is parallel to the second shelf, in a transverse direction.

19. The cordless tool holding apparatus of claim 1, wherein the side walls of the rack comprises at least one handle, for lifting the rack.

* * * * *